US005848654A

United States Patent [19]

Belcher, Jr.

[11] Patent Number: 5,848,654

[45] Date of Patent: Dec. 15, 1998

[54] LATERALLY ARTICULABLE BLADE FOR A BULLDOZER DEVICE OR THE LIKE AND METHOD FOR USE THEREOF

[76] Inventor: Cliff Belcher, Jr., HCR84 Box 104, Canyon City, Oreg. 97820

[21] Appl. No.: 674,133

[22] Filed: Jul. 1, 1996

[51] Int. Cl.[6] ..... E01H 5/06; E02F 3/76

[52] U.S. Cl. ..... 172/815; 37/274; 37/281

[58] Field of Search ..... 37/274, 281, 273, 37/283, 216; 172/815, 811, 810

[56] References Cited

U.S. PATENT DOCUMENTS

| | | | |
|---|---|---|---|
| 1,383,409 | 7/1921 | Liddell . | |
| 2,116,351 | 5/1938 | Jones et al. . | |
| 2,962,821 | 12/1960 | Peitl . | |
| 3,961,492 | 6/1976 | Buehler et al. | 172/815 X |
| 4,249,323 | 2/1981 | Mathis et al. | 172/815 X |
| 4,266,618 | 5/1981 | Wheeler et al. . | |
| 4,271,913 | 6/1981 | Wheeler et al. . | |
| 4,552,226 | 11/1985 | Platter | 172/815 |
| 4,614,048 | 9/1986 | Melby | 172/815 X |
| 4,669,205 | 6/1987 | Smathers . | |
| 4,779,363 | 10/1988 | Boutrais et al. | 172/815 X |
| 4,834,191 | 5/1989 | Vecchio | 172/815 X |
| 4,896,731 | 1/1990 | Besson . | |
| 4,962,600 | 10/1990 | Zellaha et al. | 37/274 X |
| 5,638,618 | 6/1997 | Niemela et al. | 172/815 X |

*Primary Examiner*—Terry Lee Melius
*Assistant Examiner*—Christopher J. Novosad
*Attorney, Agent, or Firm*—William A. Birdwell & Associates

[57] ABSTRACT

A laterally articulable blade for a bulldozing device. A main blade portion and an articulable blade portion extend along the same elongate axis so that the blade portions are co-linear when the blade is in a "straight" configuration. A hinge is pivotally connected to both blade portions and extensible means are provided to displace and pivot the articulable blade portion with respect to the main blade portion providing for two motions. The articulable blade portion may be displaced forwardly of the main blade portion, and the rotated inwardly.

16 Claims, 3 Drawing Sheets

LATERALLY ARTICULABLE BLADE FOR A BULLDOZER DEVICE OR THE LIKE AND METHOD FOR USE THEREOF

BACKGROUND OF THE INVENTION

This invention relates to bulldozing devices and the like, particularly the provision therein of a blade having a main portion and a laterally articulable portion for closing around material to be moved without leaving a gap therebetween.

Existing blades for bulldozing devices are generally rigid, laterally extending elongate sections having a substantially semi-circular cross-section therealong and including a blade edge for scooping an earth or road surface to be cleared, leveled or reshaped. The semi-circular blade configuration presents a bucket-like concavity to the earth or road surface for retaining material scooped by the blade edge, for carrying away the material. In order to force material into the blade concavity, at least one of three different material receiving modes must be employed. In a first material receiving mode, the blade may undercut the material, such as when it is employed for scraping soft earth. In a second receiving mode, the blade may be brought against a sufficiently large quantity of material, or a sufficiently stubborn material, that some or all of the material is forced into the concavity with forward progress of the bulldozing device rather than being forced forwardly thereby. In a third receiving mode, the blade may be forced against material that is trapped between the blade and barrier such as a wall or outcropping.

Often, however, the material to be removed is not sufficiently soft or friable to permit significant undercutting. One example would be where it is desired to remove a large rock. And while sometimes the material, by its weight or cohesive attraction, sufficiently resists forward motion of the bulldozing device to be forced thereby into the concavity, often this is not the case. Where this is not the case, it is then necessary, in order to guide the material into the blade, to trap the material between the blade and a barrier which functions as a backstop. However, a barrier is not always convenient or even available at all. Moreover, standard bulldozing blades require deft manipulation of the entire bulldozing device in order to follow the contours of a curved barrier such as a wall or outcropping.

One solution to this problem is to provide a blade with the ends bent inwardly, so as to guide material toward the laterally central portion of the blade. However, such a blade with a bent configuration is not suitable for applications, such as snow plowing, where it is desirable for the material to be urged toward and off an end of the blade.

Thence, it would be desirable to have an articulable blade which could assume either a straight or a bent configuration.

Many articulable blade devices have been provided which employ a blade which articulates in the vertical plane, to permit, for example, plowing of an uneven surface. Such devices are exemplified by Wheeler, U.S. Pat. No. 4,266,618. However, these devices do not contemplate gathering or scooping material with the two independently movable blade portions. Rather, each blade portion is employed substantially separately for plowing different areas of ground.

Accordingly, there is a need for a novel articulable blade for a bulldozing device and method for use thereof that provides an additional mode for receiving material to be moved between cooperating blade portions wherein one blade portion is articulable with respect to the other so as to move from a straight configuration to a bent configuration.

SUMMARY OF THE INVENTION

The laterally articulable blade for a bulldozing device and method for use thereof of the present invention solves the aforementioned problems and meets the aforementioned need by employing an elongate main blade portion and an elongate articulable blade portion extending along the same elongate axis. Both the main and articulable blade portions comprise respective elongated blades, which are preferably substantially of the same, semi-circular cross-section, and are disposed so as to present respective concave surfaces toward the direction of travel of a bulldozer to which the blade portions are attached. The blade portions are co-linear when the blade is in a "straight" configuration and the main portion abuts the articulable portion at coextensive curvilinear edges, the edges forming a concavity when viewed from the direction of travel of the bulldozer employed for moving material on or in a ground surface.

The articulable blade portion is attached to the main blade portion through a hinge which is pivotally mounted at a first end, behind the distal end of the main blade portion, and is mounted at a second end, behind a proximal end of the articulable blade portion, permitting the hinge to pivot at both ends about axes that are inclined substantially perpendicular to the elongate dimension of the blade. The hinge is bent, so that it extends from the first end backwardly with respect to the direction of travel, and again forwardly, to permit the articulable blade portion to be moved forwardly of the main blade portion without interfering therewith.

Extension means for displacing and pivoting the articulable blade portion with respect to the main blade portion provide for two motions for moving the articulable portion from the "straight" configuration to the "bent" configuration: (1) the articulable blade portion may be displaced forwardly of the main blade portion, in anticipation of (2) rotating the articulable portion inwardly. This, in cooperation with the curvilinear abutment of the articulable portion with the main portion in the "straight" configuration, permits the articulable blade portion to pivot toward the main blade portion without interference therewith, and permits the edge of the articulable portion to contact the front surface of the main portion substantially along its entirety, so that material being gathered by the two blade portions is substantially contained therebetween.

Therefore, it is a principal object of the present invention to provide a novel laterally articulable blade for a bulldozing device or the like and method for use thereof.

It is another object of the present invention to provide such an articulable blade which provides for grasping and retaining material that might otherwise tend to be pushed away from the bulldozing device.

It is a further object of the present invention to provide such an articulable blade which permits adjustment of its effective length for following curved upright surfaces.

It is yet a further object of the present invention to provide such an articulable blade that provides for closing of an articulable blade portion with respect to another blade portion such that substantially maintains contact between the blade portions.

It is yet another object of the present invention to provide such an articulable blade that provides for the maintenance of contact between the blade portions during a substantially complete range of articulation of the articulable blade portion.

The foregoing and other objects, features and advantages of the present invention will be more readily understood upon consideration of the following detailed description of the invention, taken in conjunction with the following drawings.

DETAILED DESCRIPTION OF A PREFERRED EMBODIMENT

Figure 1:
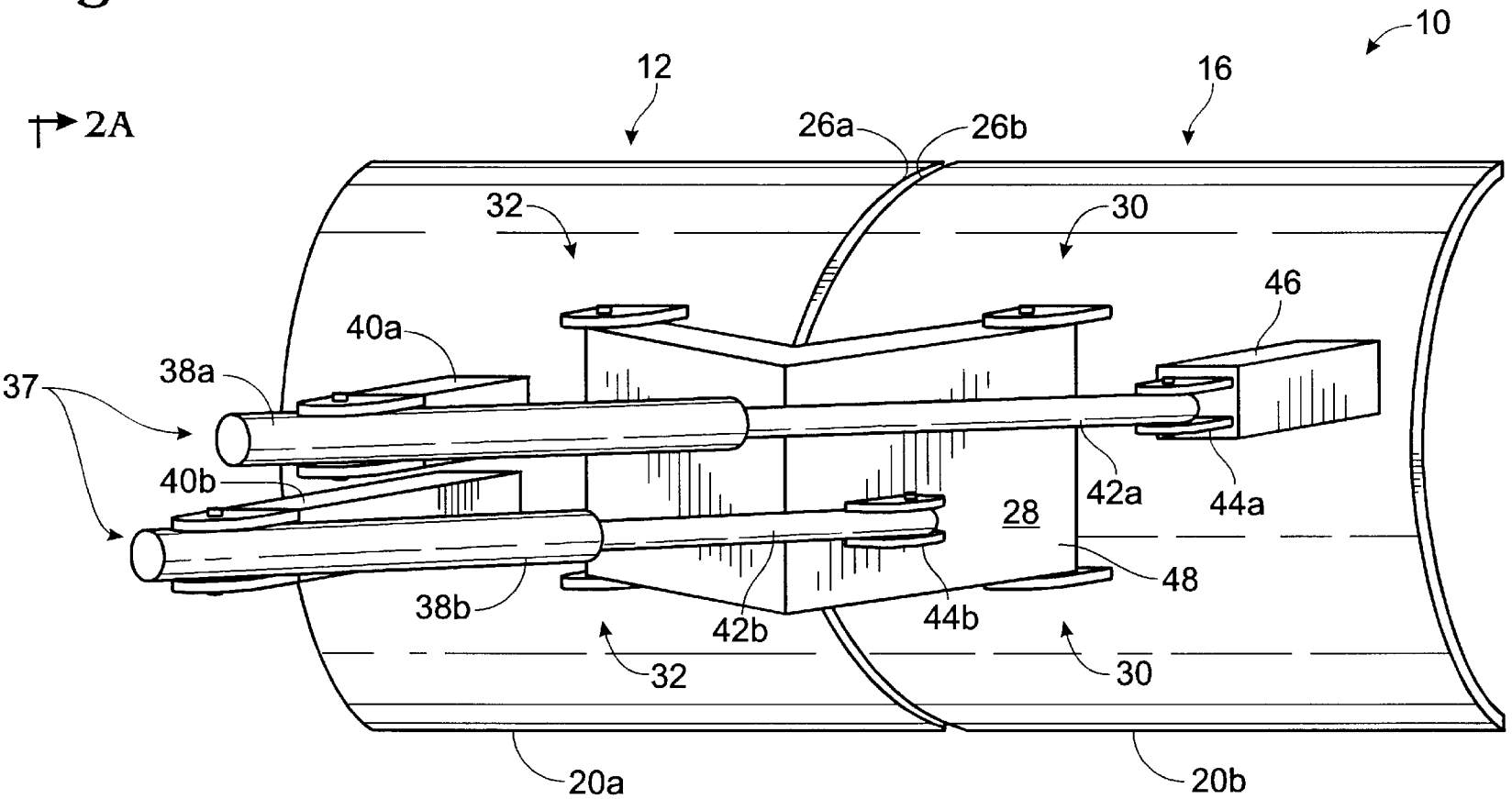
FIG. 1 is a back, pictorial view of an articulable blade for a bulldozing device or the like in a "straight" configuration according to the present invention.
Figure 2A:
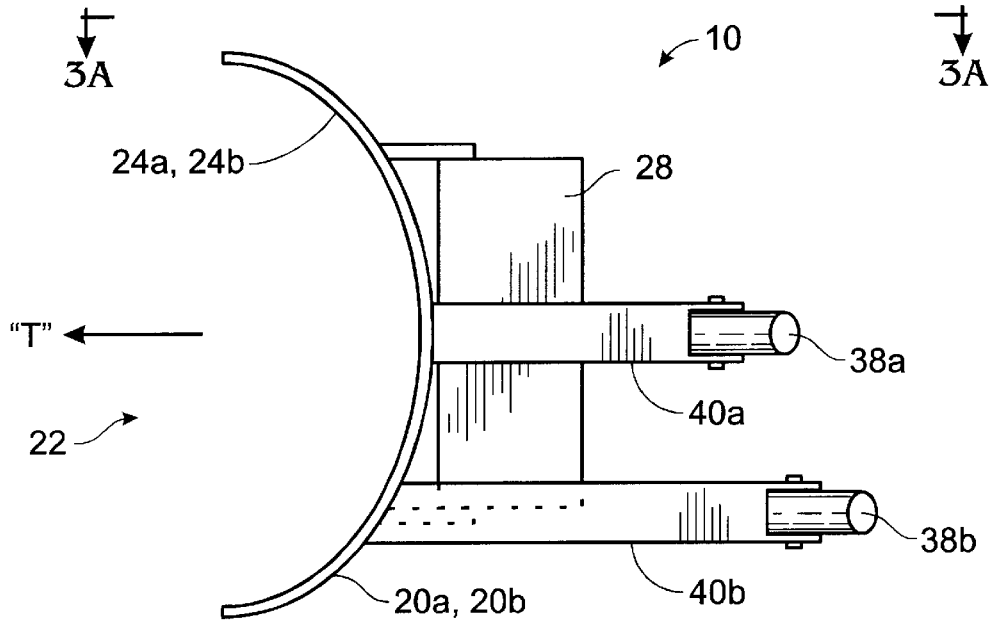
FIG. 2A is a side elevation of the articulable blade of FIG. 1 in a "straight" configuration.

Referring particularly to FIGS. 1 and 2A, a preferred embodiment of an articulable blade 10 for a bulldozing device or the like for moving material on or in a ground surface comprises a main blade portion 12 which attaches to a bulldozing device (not shown) in, preferably, a standard manner. The main blade portion 12 is generally laterally disposed with respect to the fore-aft dimension of the bulldozing device, although the blade portion 12 may be angled with respect thereto in order to function as, e.g., a snowplow.

The blade 10 also includes an articulable blade portion 16 normally extending laterally from the main blade portion 12 to form a "straight" configuration of the blade 10, so that the two blade portions 12, 16 are substantially co-linear. In the straight configuration, the blade 10 functions substantially as a standard blade for a bulldozing device such as has been described above.

Both the main and articulable blade portions preferably comprise respective concave blade shapes 20*a*, 20*b*, with respect to the forward direction of the bulldozing device (shown as "F" in FIG. 2A, preferably having a substantially semi-circular cross section. However, the blade portions may have flat blade shapes or other desirable blade shapes.

The main and articulable blade portions include respective mating edges 26*a*, 26*b* which maintain contact with one another in the straight configuration. For a concave blade shape 20*a*, the mating edge 26*b* of the articulable blade portion 16 is preferably convex, for substantially sealing against the concave front surface 24*a* of the main blade portion when the blade 10 is in a "bent" configuration which will be described below. Accordingly, for a similiarly concave blade shape 20*b*, the mating edge 26*a* is preferably concave, for substantially sealing against the mating edge 26*b* when the blade 10 is in a straight configuration.

The articulable blade portion 16 is connected to the main blade portion through a hinge 28. The hinge 28 is connected at a first pivotal connection 30 to the articulable blade portion on the back side thereof and at a second pivotal connection 32 to the main blade portion 12 on the back side thereof. The pivotal connections 30 and 32 permit pivoting of the hinge about an axis that is substantially perpendicular to the elongate dimension of the blade 10. The hinge 28 is bent so that, in the straight configuration of the blade 10, the hinge extends rearwardly from the first pivotal connection 30 and then forwardly toward the second pivotal connection, to permit the articulable blade portion 16 to be pivoted forwardly of the main blade portion 12 into the bent configuration without interfering therewith.

Extension means 37 are provided for pivoting the articulable blade portion 16 about the main blade portion 12. Preferably, the extension means 37 comprise two hydraulic cylinders 38*a*, 38*b* which are pivotally mounted behind the main blade portion, at respective mounts 40*a*, 40*b* extending backwardly from the main blade portion 12. The cylinders are disposed so that they may pivot a predetermined amount without interfering with their respective bracket.

The cylinders 38*a*, 38*b* comprise respective pistons 42*a*, 42*b* having respective rods 44*a*, 44*b* which are permitted to extend outwardly from the cylinders upon pressurization of a fluid therein. The rod 44*a* of the piston 42*a* is pivotally connected to and behind the articulable blade portion 16 at a third pivotal connection 46. The rod 44*b* of the piston 42*b* is pivotally connected to a rearwardly facing face 48 of the bracket 28. Both pivotal connections permit pivoting about substantially the same axis as is permitted the bracket 28.

OPERATION

Figure 2B:
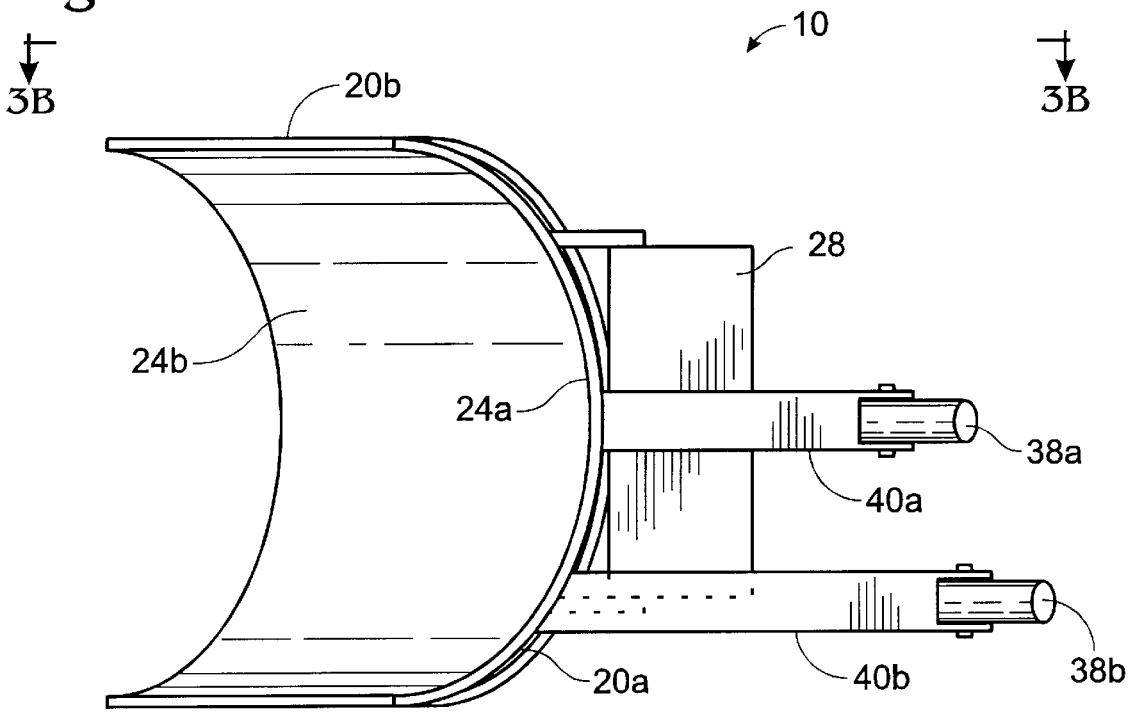
FIG. 2B is a side elevation of the articulable blade of FIG. 1 in a "bent" configuration.
Figure 3A:
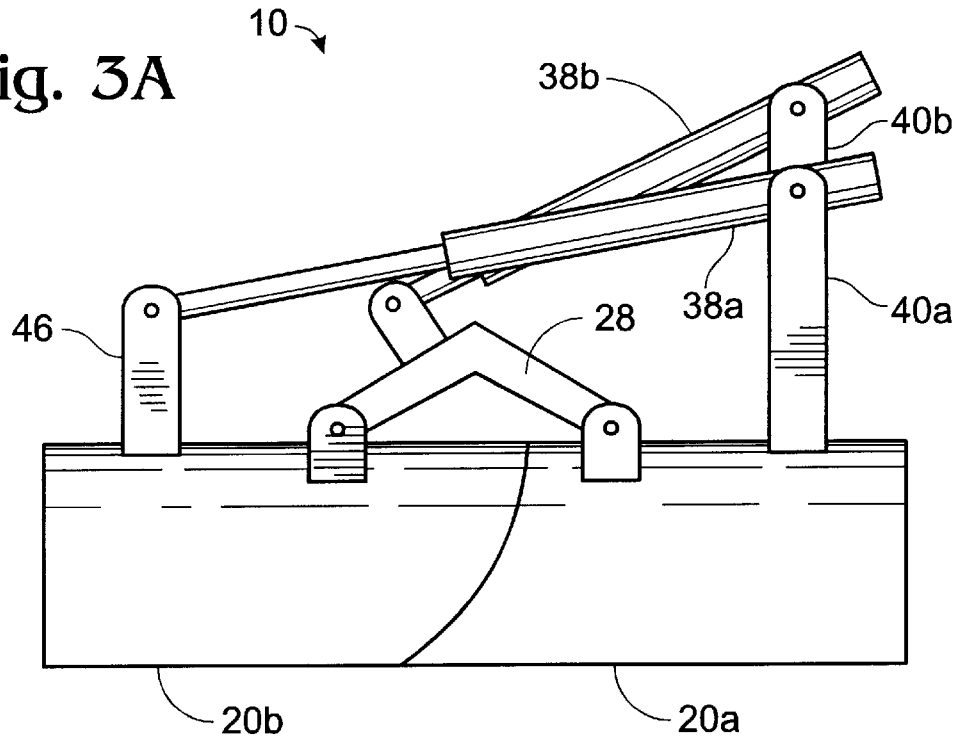
FIG. 3A is a top view of the articulable blade of FIG. 2A.
Figure 3B:
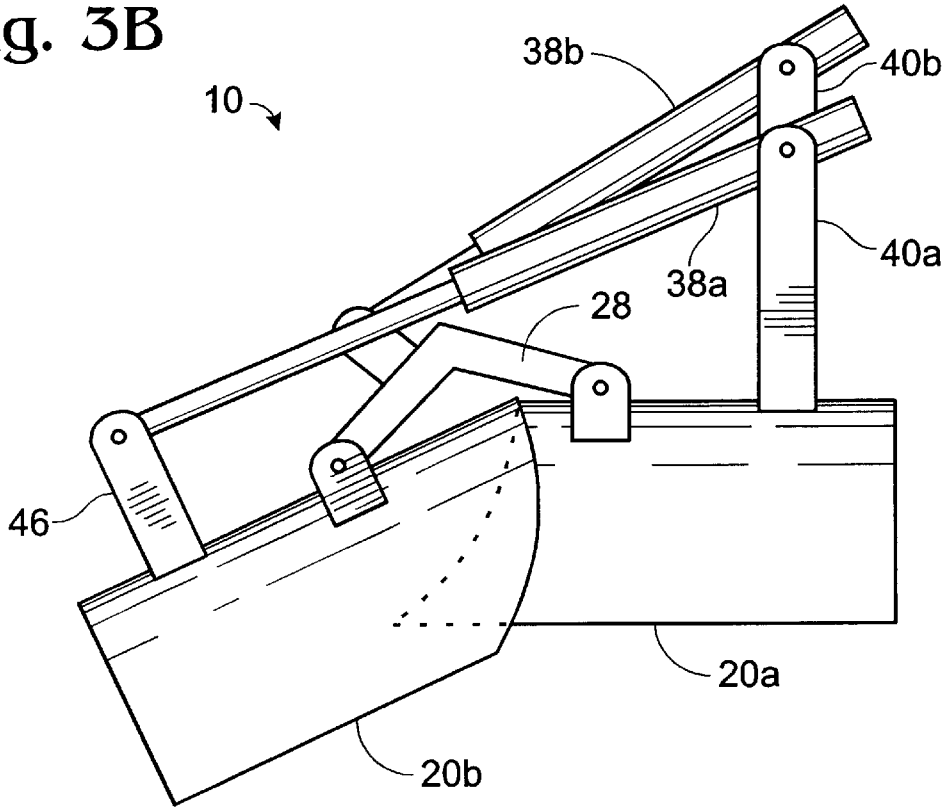
FIG. 3B is a top view of the articulable blade of FIG. 2B.

With reference particularly to FIGS. 2A, 2B and 3A, 3B, combinatorial operation, by selective pressurization, of the cylinders 38*a*, 38*b* provides for two motions of the articulable blade portion 16 with respect to the main blade portion 12, for moving the articulable portion from a "straight" configuration to a "bent" configuration: (1) the articulable blade portion 16 may be displaced forwardly of the main blade portion 12 by the piston 42*a*, in anticipation of (2) pivoting the articulable portion inwardly, which is effected primarily by the piston 42*b*. Thus, in FIGS. 2A and 2B, the main portion 12 and the articulable portion 16 of the blade are positioned in a straight configuration. When the hydraulic cylinder 38*b* is actuated, the articulable portion 16 moves slightly forward of the main portion so that the edge 26*b* of portion 16 clears the edge 26*a* of the main portion. Then, when the hydraulic cylinder 38*a* is thereafter actuated, the articulable portion pivots at connection 30 to form an angle of less than 180 degrees with the main portion, thereby producing the bent configuration, as shown in FIGS. 2B and 3B. The hinge 28 permits the articulable blade portion 16 to move forwardly of the main blade portion 12 without interfering therewith, while the convex mating edge 26*b* of the articulable blade portion permits the articulable blade portion to substantially seal against the concave surface 24*a* of the main blade portion when in the bent configuration.

The bent configuration of the blade 10 permits adjustment of its length, for following curved upright surfaces, such as barrier walls or outcroppings, and permits grasping of material between the front surface 24*a* of the main blade portion and the similar front surface 24*b* of the articulable blade portion, thereby providing an additional material receiving mode in a bulldozing device or the like.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

I claim:

1. An articulable blade for a material moving device, comprising:

an elongate main blade portion having a curved front surface and a first lateral edge;

an elongate articulable blade portion having a front surface and a second lateral edge adapted for substantially sealing against said first lateral edge in a first configuration of said articulable blade portion; and a hinge portion pivotally connecting said main blade portion to said articulable blade portion, said hinge portion being adapted to permit said articulable blade portion to move forwardly of and rotate toward said front surface of said main blade portion from said first configuration, wherein said front surface of said articulable blade portion forms a first angle with respect to said main blade portion to a second configuration wherein said articulable blade portion forms a second angle with respect thereto and substantially seals against said front surface of said main blade portion.

2. The articulable blade of claim 1, wherein said hinge portion is attached to said main blade portion at a first pivotal connection and to said articulable blade portion at a second pivotal connection.

3. The articulable blade of claim 2, wherein said hinge portion is bent and a first hydraulic cylinder is connected between said main blade portion and said hinge portion for rotating said hinge portion about said first pivotal connection.

4. The articulable blade of claim 3, further comprising a second hydraulic cylinder connected between said main blade portion and said articulable blade portion for rotating said articulable blade portion about said second pivotal connection.

5. The articulable blade of claim 1, wherein said articulable blade portion has a front surface, wherein said second lateral edge extends away from said front surface of said articulable blade portion at an acute angle and wherein said first lateral edge extends away from said front surface of said main blade portion at an obtuse angle.

6. The articulable blade of claim 5, further comprising a hinge portion pivotally connected to said main blade portion at a first pivotal connection and to said articulable portion at a second pivotal connection spaced laterally from said first pivotal connection.

7. The articulable blade of claim 6, further comprising a first extensible means, connected to said articulable blade portion, for moving said articulable blade portion forward of said main blade portion, and a second extensible means, connected to said hinge portion, for rotating said articulable blade portion toward said main blade portion.

8. The articulable blade of claim 7, wherein said first extensible means comprises a hydraulic cylinder connected between said main blade portion and said articulable blade portion.

9. The articulable blade of claim 7, wherein said second extensible means comprises a hydraulic cylinder connected between said main blade portion and said articulable blade portion.

10. The articulable blade of claim 5, wherein said second lateral edge substantially seals against said front surface of said main blade portion in said second configuration.

11. A method for adjusting the shape of a blade, comprising the steps of:

providing a blade having an elongate main blade portion having a front surface and a first lateral edge, and an elongate articulable blade portion having a second lateral edge adapted for substantially sealing against said first lateral edge in a first configuration of said articulable blade portion; and moving said articulable blade portion forwardly of said front surface; and rotating said articulable blade portion toward said front surface from said first configuration, wherein said articulable blade portion forms a first angle with respect to said main blade portion, to a second configuration wherein said articulable blade portion forms a second angle with respect thereto and substantially seals against said front surface.

12. The method of claim 11, wherein said articulable blade portion is moved forwardly before it is rotated.

13. The method of claim 11, wherein said moving and said rotating of said articulable blade portion to said second configuration substantially seals between said second lateral edge and said front surface.

14. A method for moving material, comprising:

providing a blade having an elongate main blade portion having a front surface and a first lateral edge, and an elongate articulable blade portion connected to said main blade portion and having a second lateral edge adapted for substantially sealing against said first lateral edge in a straight configuration of said articulable blade portion;

positioning said main blade portion proximate material to be moved;

moving said articulable blade portion forwardly of said front surface; and rotating said articulable blade portion toward said front surface from said straight configuration, wherein said articulable blade portion is substantially co-linear with said main blade portion, to a bent configuration, wherein said articulable blade portion assumes a first angular relationship thereto and substantially seals against said front surface, to gather said material inwardly of said articulable blade portion when said material is moved by said blade portions.

15. The method of claim 14, further comprising the step of pivoting said articulable blade portion from said first bent configuration to a second bent configuration wherein said articulable blade portion assumes a second angular relationship to said main blade portion and said second lateral edge substantially seals against said front surface of said main blade portion.

16. The method of claim 14, wherein said moving and said rotating of said articulable blade portion into said first bent configuration substantially seals between said second lateral edge and said front surface.

* * * * *